US006347960B1

(12) United States Patent
Chen

(10) Patent No.: US 6,347,960 B1
(45) Date of Patent: Feb. 19, 2002

(54) MODULE CONNECTOR

(75) Inventor: Chun-Yuan Chen, Taipei Hsien (TW)

(73) Assignee: L&K Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 09/607,856

(22) Filed: Jun. 29, 2000

(51) Int. Cl.[7] ..... H01R 13/648
(52) U.S. Cl. ..... 439/607; 439/669
(58) Field of Search ..... 439/607, 608, 439/609, 108, 630, 637, 668, 669

(56) References Cited

U.S. PATENT DOCUMENTS 5,190,480 A * 3/1993 Chau et al. ..... 439/637
5,685,739 A * 11/1997 Davis et al. ..... 439/607
5,993,258 A * 11/1999 Matsunuma et al. ..... 439/607
6,036,544 A * 3/2000 Brunker et al. ..... 439/607
6,095,062 A * 8/2000 Doye et al. ..... 439/607
6,095,861 A * 8/2000 Lin et al. ..... 439/607

* cited by examiner

*Primary Examiner*—Hien Vu
(74) *Attorney, Agent, or Firm*—Pro-Techtor International Services

(57) ABSTRACT

A module connector, to be assembled onto a mobile phone, for the purpose of telecommunication with outside sources, comprising: an insulating unit and an enveloping unit, wherein the insulating unit is a flattened and elongated square shape, having terminal accommodating grooves and charging terminal units, the enveloping unit is a frame surrounding the insulating unit, characterized in that: the charging terminal unit accommodates switch-type charging terminals, in other words, the charging terminal involves at least a first charging terminal and a second charging terminal that are in contact or separated under normal conditions, but will activate the conduction between the two charging terminals when a charging plug is inserted, thus providing correct connection of the charging plug only when it is aligned correctly in position, to conduct electrical power and ensure steady charging efficiency.

11 Claims, 6 Drawing Sheets

MODULE CONNECTOR

BACKGROUND OF THE INVENTION

1. Field of the Invention

The invention relates to a module connector, particularly to a module connector with telecommunication and charging functions, used on a mobile phone, involving switch-type control of transmission of charging signals, meanwhile, its whole unit is a low-profile structure, enabling the reduction in size and thickness of the mobile phone to be assembled.

2. Description of Related Art

Conventionally, a module connector assembled to the mobile phone basically comprises conductive terminals for telecommunication and charging terminals for charging purposes. However, charging terminals for such conventional connectors are generally designed to involve column-shaped terminal devices, while a matching charging plug is designed as a hollow column device, inside the hollow column is a ring-shaped terminal to contact the column-shaped terminal, so when the charging plug is inserted into the charging slot of the module connector, the ring-shaped terminal and the column-shaped terminal are connected for charging process. However, the conductive areas of the circumferences of column-shaped terminal and the ring-shaped terminal are charge, which requires high precision and involves difficulty in assembling process, and hence, increased production costs.

Furthermore, a conventional charging plus involves an outer layer of metal, a medium layer of plastics and an inner layer of ring-shaped terminal, therefore, the charging slot on the module connector is made to have an outer layer of plastics and a medium layer of column-shaped terminal, to avoid short-circuit. In consideration of the formation of outer layer of plastics in a conventional type of module connector, its height is restricted to a certain range of allowance, and could not be reduced further. Therefore, it could not meet the trend of design for compact and light-weight electronic products.

SUMMARY OF THE INVENTION

It is therefore an objective of this invention to provide a module connector, by changing the assembling type of terminal, the charging slot of the connector can be connected in firm contact with a charging plug, and its production and assembling process can be made less sophisticated and more convenient.

It is another objective of this invention to provide a new design of the charging slot of a module connector, so the size of the module connector is reduced, enabling further reduction of the integral size of the mobile phone, to meet the trend of design for compactness and lightweight.

CHARACTERISTICS OF THE INVENTION

The invention of module connector is characterized in that: the charging terminal unit of the module connector accommodates switch-type charging terminals, which ensures that the charging plug must be correctly aligned for proper insertion and conductance of electrical power, and ensures steady charging efficiency.

With the above characteristic, the switch-type charging terminal comprises: a first charging terminal and a second charging terminal, the two charging terminals are in mutual contact or separated under normal conditions, and the two charging terminals will be connected when a charging plug is inserted.

Another characteristic of the invention of module connector lies in that: the first and second charging terminals respectively comprise: contact parts, interference parts and connecting parts, wherein the contact parts are properly bent to increase mutual contact and contact flexibility.

Another characteristic of the invention of module connector lies in that: between the operating cycles of the first and the second charging terminals is a third charging terminal, which controls the contact in coordination with the dislocation of the first or second charging terminal.

BRIEF DESCRIPTION OF DRAWINGS

The invention can be fully understood by reading the following detailed description of the preferred embodiments, with reference made to the accompanying drawings, wherein.

BRIEF DESCRIPTION OF NUMERALS

Figure 1:
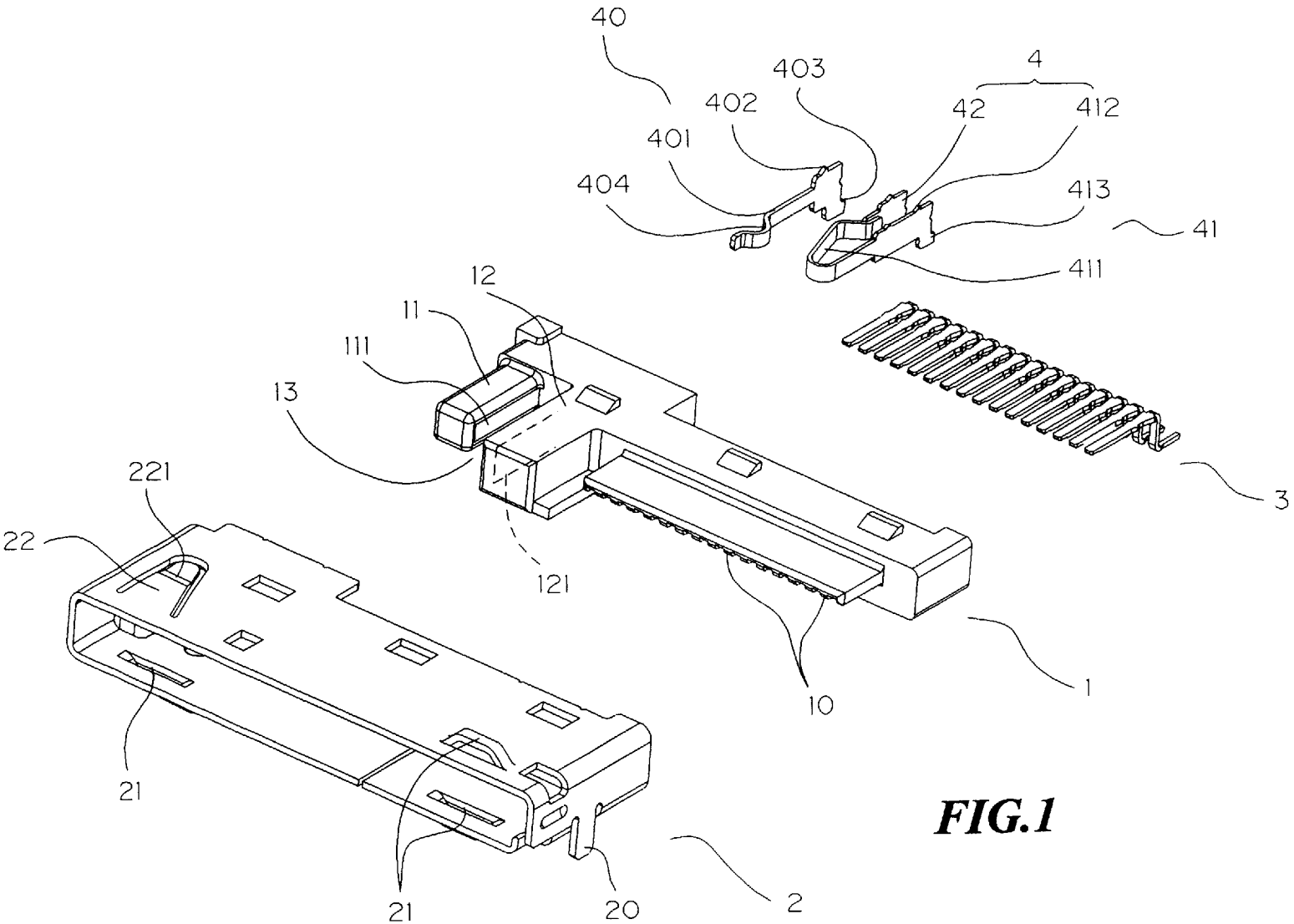
FIG. 1 is a perspective, disassembled view of the invention.

1 insulating unit
11 first charging terminal unit
13 connecting space
20 positioning post
22 check plate
3 terminal
4, 4', 4" charging terminal
40, 40', 40" first charging terminal
41, 41', 41" second charging terminal
10 terminal accommodating groove
12 second charging terminal unit
2 enveloping unit
21 stop plate
221 step part
42 third charging terminal
401,411 contact part
402, 412 interference part
403,413 connecting part

DETAILED DESCRIPTION OF PREFERRED EMBODIMENTS

As illustrated in FIG. 1, the present invention of mobile phone connector comprises: an insulating unit 1, an enveloping unit 2, a set of terminals 3, and a charging terminal 4, the insulating unit 1 is a flattened and elongated square shape, on which is a plurality of terminal accommodating grooves 10, which serve to accommodate positioning terminals 3. Next to the terminal accommodating groove 10 are a first charging terminal unit 11 and a second charging terminal unit 12, which serve to accommodate the charging terminal 4. Between the first and the second charging terminal units 11, 12 is a connecting space 13. On opposite sides of the first and the second charging terminal units 11, 12 are side openings 111, 121, which serve to expose the contact end of the accommodated charging terminal 4 (to be described later) for communication contact with the matching charging plug (not shown in drawing). The depth of the first charging terminal unit is slightly less than the second charging terminal unit 12, which is designed to work with the connecting space and form a connecting area for the charging plug. In other words, the location of the first charging terminal unit 11 is so designed that the charging plug shall be inserted only when it is correctly aligned, and that no misconnection will occur.

Figure 2:
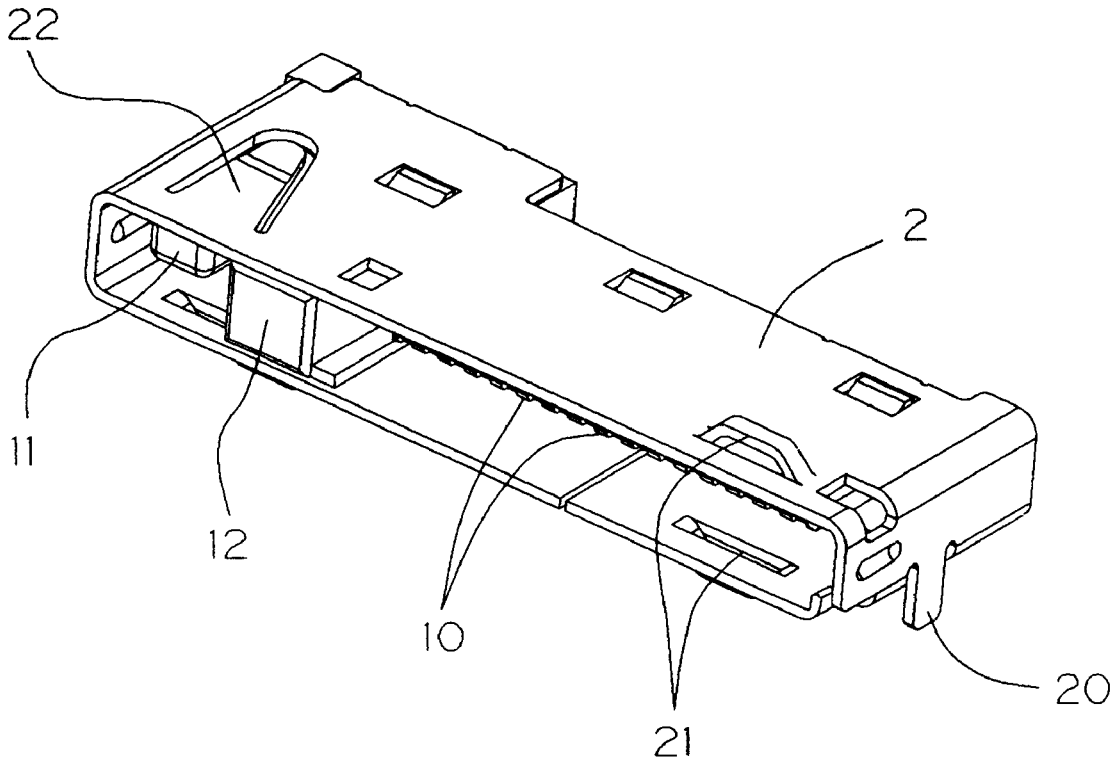
FIG. 2 is a perspective, assembled view of FIG. 1.

The enveloping unit 2, made of metal, envelops the insulating unit 1 and obstruct the terminal accommodating groove 10 and the first and second charging terminal units 11, 12. As mentioned above, the area enveloped by the enveloping unit 2, the connecting space 13 and the first charging terminal unit 11 forms a charging slot to enable connection to the charging plug. On the bottom of two sides of the enveloping unit 2 are positioning posts 20, which serve to position the connector onto the circuit board. On the upper and lower ends of one side of the enveloping unit 2 is punched to form an arched stop plate 21, which will rest against the edge of the circuit board 60 when it is assembled (shown in FIGS. 3 and 4), and serve to prevent excessive depth of insertion. On the enveloping unit 2 and opposite the second charging terminal unit 12 is a flexible check plate 22, the check plate 22 is pressed inwardly to form on the enveloping unit 2 opposite the connecting space 13, providing the check plate with clamping strength in connection. On the check plate 22 is the formation of a depressed step part 221, which will enhance steady connection with the charging plug. Furthermore, the end of the check plate 22 is designed to be thinner to strengthen the operating flexibility of the check plate 22. As shown in FIG. 2 that illustrates the invention when it is assembled, the enveloping unit 2 encompasses the whole area framed by the terminal accommodating groove 10 and the first and second charging terminal units 11, 12 is a flattened square shape, and, it will effectively prevent interference from foreign signals under the obstruction of the enveloping unit 2.

The charging terminal 4 in the embodiment of the present invention comprises: a first charging terminal 40, a second charging terminal 41 and a third charging terminal 42, wherein, the first and the second charging terminals 40, 41 are separated under normal conditions. The first and second charging terminals 40, 41 respectively comprise: contact parts 401, 411, interference parts 402, 412 and connecting parts 403, 413. The end of the contact part 401 of the first charging terminal 40 has a bent arch 404, the end of the contact part 411 of the second charging terminal 41 is folded towards a welding part 413 opposite the end of the first charging terminal 40, close to the arch 404 of the first charging terminal 40, its end becoming a free end, thereby enhancing the touch and contact flexibility of respective contact parts. Furthermore, near the bent free end of the second charging terminal 41 the one end of the third charging terminal 42 is in contact with said free end, thus, when a charging plug is inserted and the second charging terminal 41 is pushed open to one side, the free end will be separated from the third charging terminal 42 and electrical power will be conducted.

Figure 3:
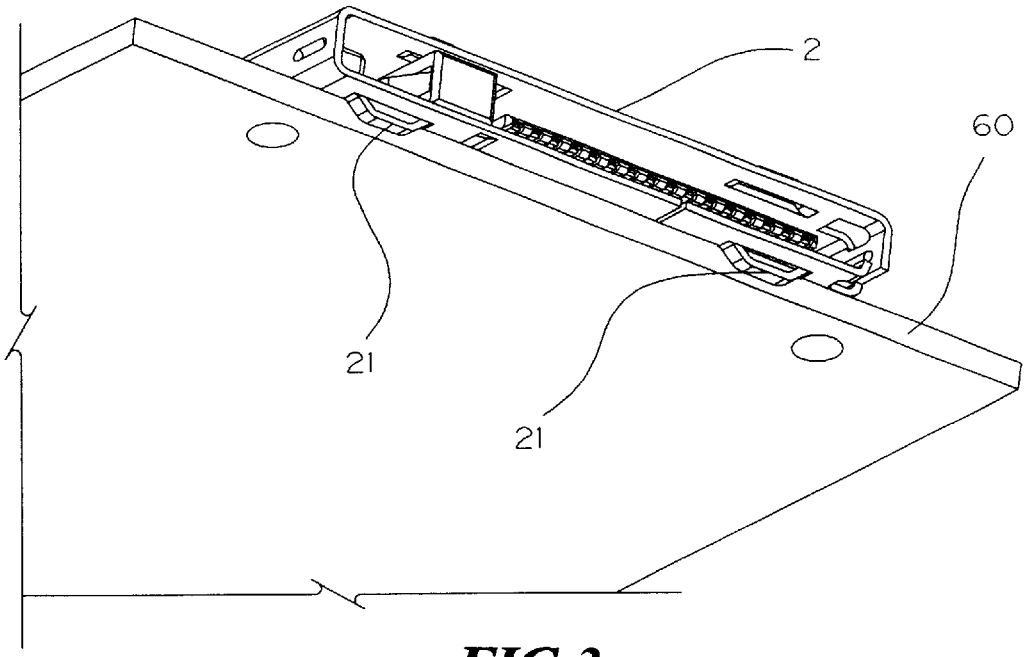
FIG. 3 is a perspective view of the invention as it is assembled to the circuit board.
Figure 4:
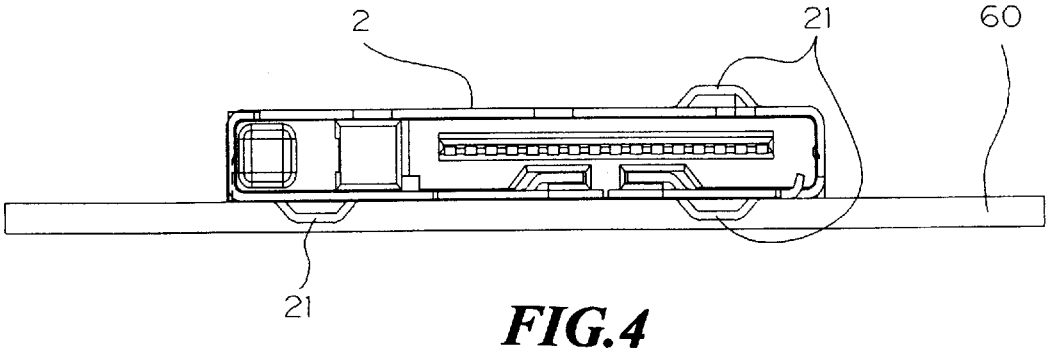
FIG. 4 is a front view of the invention as it is assembled to the circuit board.
Figure 5:
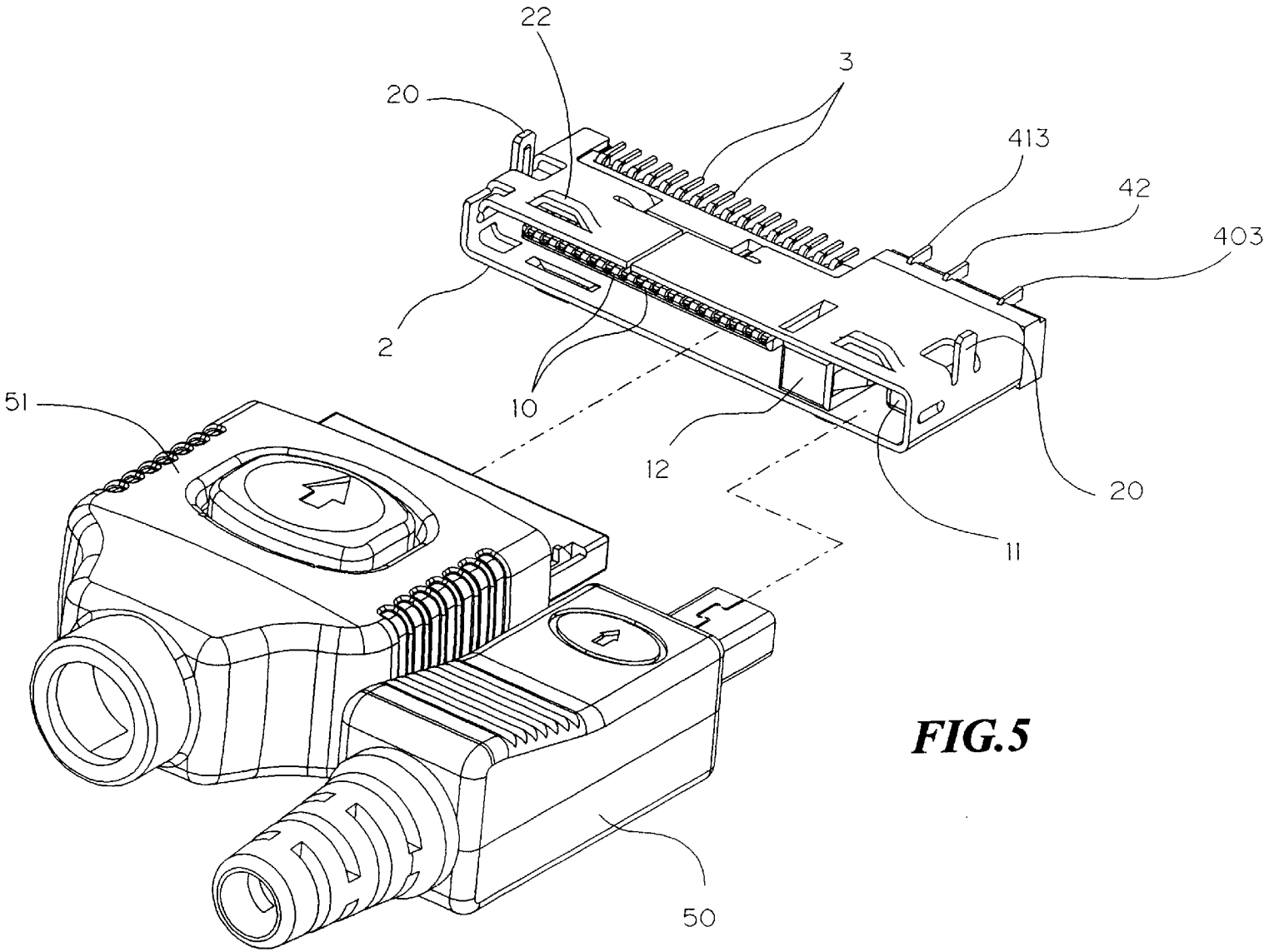
FIG. 5 is a perspective, disassembled view of a charging plug and telecommunication plug with the invention.

As shown in FIG. 5 which is a 180-degree reversion of FIG. 2, in the present invention of module connector, the terminals 3 and the connecting parts 403, 413, and the third charging terminal 42 are welded horizontally to the circuit board, as shown in FIGS. 3 and 4, to provide connection with the charging plug 50 and the telecommunication plug 51.

Figure 6:
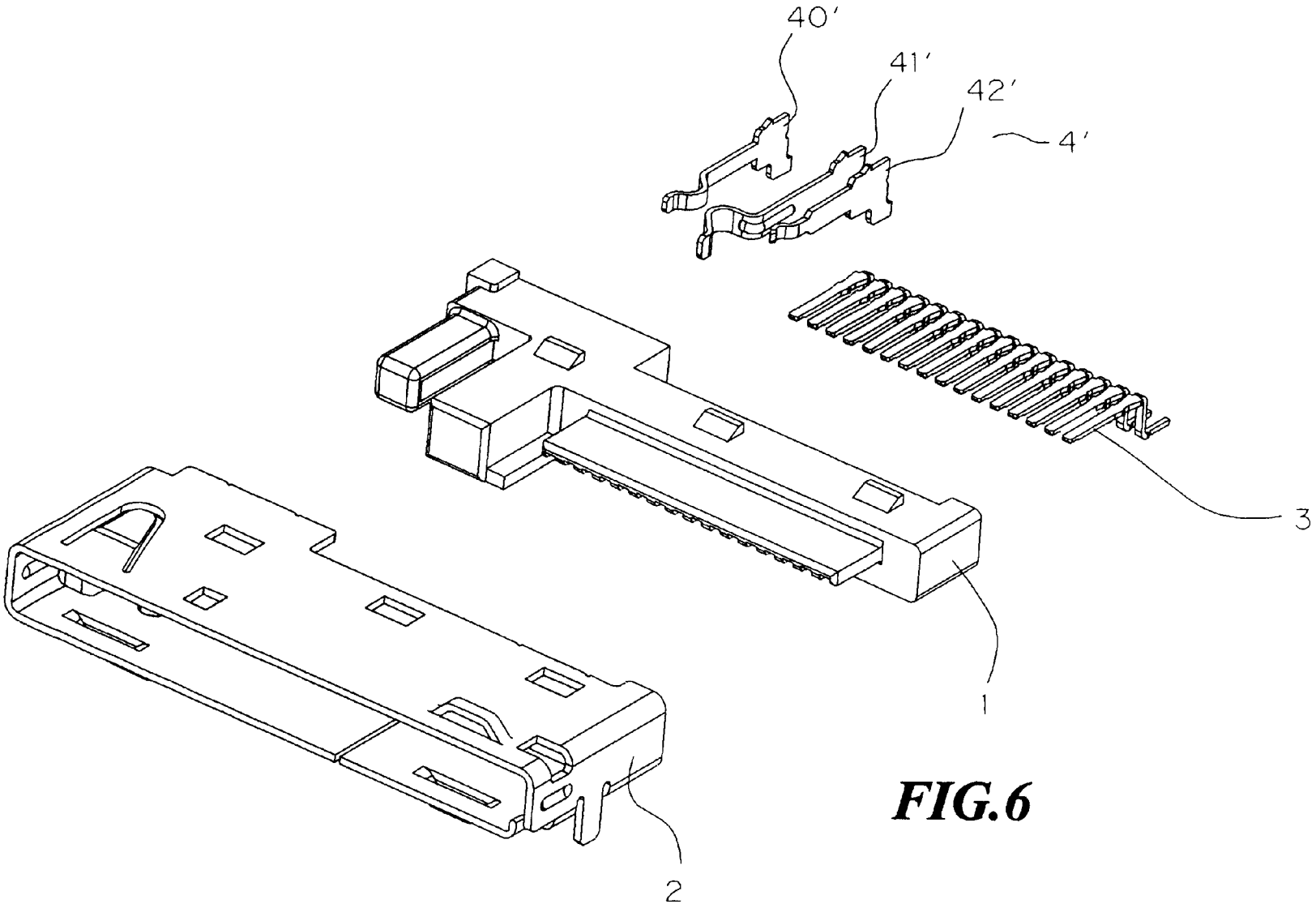
FIGS. 6 and 7 are the second and third embodiments of the invention.
Figure 7:
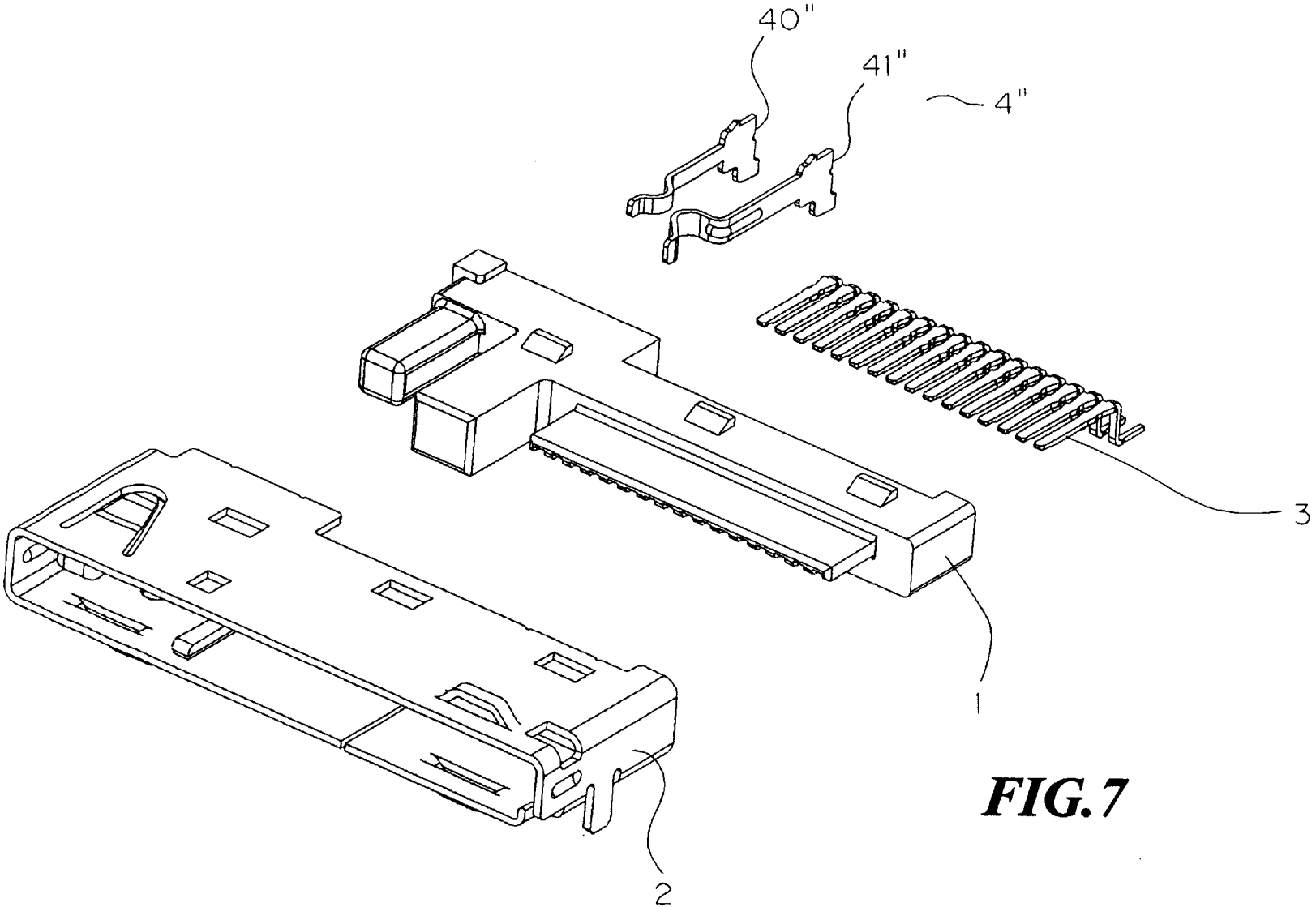

FIGS. 6 and 7 illustrate the second and the third embodiment views of the invention of module connection, the construction shown in the two embodiments are the same as the insulating unit 1, the enveloping unit 2 and the terminal 3 shown in the first embodiment. The difference lies in the layout of the charging terminal 4, the charging terminal 4' shown in the second embodiment in FIG. 6 comprises: a first charging terminal 40', a second charging terminal 41' and a third charging terminal 42', the three charging terminals 40', 41', 42' are separated under normal conditions, in other words, when the charging plug is inserted, the second charging terminal 41' is pushed open to one side, and the third charging terminal 42' is connected to conduct the electrical power source. The charging terminal 4" shown in the third embodiment view in FIG. 7 comprises: a first charging terminal 40" and a second charging terminal 41", the two charging terminals 40", 41" are separated under normal conditions, in other words, when the charging plug is inserted, it directly connect the first and second charging terminals 40", 41" and conduct the power source. Such installation is able to achieve the purposes of consistent charging and firm connection of the charging plug.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretations so as to encompass all such modifications and similar arrangements.

What is claimed is:

1. A module connector, comprising:

an insulating unit, said insulating unit comprises a plurality of terminal accommodating grooves and a plurality of charging terminal units, a plurality of terminals received in said terminal accommodating grooves, one end of each of said terminals being welded to a circuit board, and a second end of each of said terminals receiving corresponding terminals of a matching telecommunications plug when said telecommunications plug is inserted into said module connector, a charging terminal comprising at least a first charging terminal and a second charging terminal, said first and second charging terminals being separated under normal conditions, a metallic enveloping unit, said enveloping unit comprising a frame that surrounds said terminal accommodating grooves and said charging terminal units; wherein a first charging terminal unit having a first rectangular cross section for accommodating said first charging terminal, a second charging terminal unit having a second rectangular cross section for accommodating said second charging terminal, such that when a corresponding charging plug with a rectangular cross section is inserted onto said first charging terminal unit to connect said first and second charging terminals, said charging plug can be inserted onto said first charging terminal unit in only one orientation due to said rectangular cross sections of said first charging terminal unit and said charging plug, wherein opposing sides of said first and second charging terminal units are openings which serve to expose contact ends of said first and second charging terminals.

2. The module connector as claimed in claim 1, wherein:

said first and said second charging terminals each comprise a contact part, an interference part, and a connecting part, said contact parts of said first and said second charging terminals being bent in opposing arches.

3. The module connector as claimed in claim 1, wherein:

said charging terminal comprises a third charging terminal.

4. The module connector as claimed in claim 1, wherein:

said first and said second charging terminals each comprise a contact part, an interference part, and a connecting part, an end of said contact part of said first charging terminal being arched, and an end of said contact part of said second charging terminal being folded toward a welding part opposite said first charging terminal.

5. The module connector as claimed in claim 4, wherein:

near a folded end of said second charging terminal is a third charging terminal, one end of said third charging terminal is in contact with said folded end.

6. The module connector as claimed in claim 1, wherein:

said enveloping unit has a flattened rectangular cross section.

7. The module connector as claimed in claim 1, wherein:

a flexible check plate is provided on said enveloping unit.

8. The module connector as claimed in claim 7, wherein:

said check plate comprises a depressed step part.

9. The module connector as claimed in claim 1, wherein:

a space is situated between said first and said second charging terminals.

10. The module connector as claimed in claim 1, wherein:

positioning posts are located on a bottom of two sides of said enveloping unit.

11. The module connector as claimed in claim 1, wherein:

stop plates are located on upper and lower ends of one side of said enveloping unit.

* * * * *